US006474404B1

(12) United States Patent
Grothe et al.

(10) Patent No.: US 6,474,404 B1
(45) Date of Patent: Nov. 5, 2002

(54) METHOD AND DEVICE FOR CONTROLLING AND/OR MAINTAINING THE TEMPERATURE OF A MELT, PREFERABLY OF A STEEL MELT DURING CONTINUOUS CASTING

(75) Inventors: Horst Grothe, Kaarst (DE); Markus Reifferscheid, Ratingen (DE); Raimund Brückner, Niedernhausen-Engenhahn (DE); Karl Heinz Schmitt, Daaden (DE)

(73) Assignees: SMS Schloemann-Siemag Aktiengesellschaft, Düsseldorf (DE); Didier Werke AG, Wiesbaden (DE)

( * ) Notice: Subject to any disclaimer, the term of this patent is extended or adjusted under 35 U.S.C. 154(b) by 0 days.

(21) Appl. No.: 09/869,739

(22) PCT Filed: Jan. 7, 2000

(86) PCT No.: PCT/EP00/00058

§ 371 (c)(1),
(2), (4) Date: Oct. 15, 2001

(87) PCT Pub. No.: WO00/41829

PCT Pub. Date: Jul. 20, 2000

(30) Foreign Application Priority Data

Jan. 13, 1999 (DE) ..... 199 00 915

(51) Int. Cl.[7] ..... B22D 11/16

(52) U.S. Cl. ..... 164/452; 164/133; 164/154.6; 164/455; 164/338.1; 164/513

(58) Field of Search ..... 164/133, 154.6, 164/452, 455, 338.1, 513

(56) References Cited

U.S. PATENT DOCUMENTS 4,469,162 A 9/1984 Hanas et al.
5,084,089 A * 1/1992 Zekely et al. ..... 75/10.12
5,902,509 A * 5/1999 Bruckner et al. ..... 219/644
6,226,314 B1 * 5/2001 Bruckner et al. ..... 373/142

FOREIGN PATENT DOCUMENTS

| | | | |
|---|---|---|---|
| DE | 197 52 548 A1 | | 6/1999 |
| EP | 0755741 | | 1/1997 |
| JP | 02-207949 | * | 8/1990 |

OTHER PUBLICATIONS

Patent Abstracts of Japan, vol. 014, No. 501 (M–1043), Nov. 2, 1990 & JP 02 207949 A (Sumitomo Heavy Ind LTD), Aug. 17, 1990.

Patent Abstracts of Japan, vol. 016, No. 034 (M–1204), Jan. 28, 1992 & JP 03 243254 A (NKK), Oct. 30, 1991.

Patent Abstracts of Japan, vol. 009, No. 132 (M–385), Jun. 7, 1985 & JP 60 015054 A (Ishikawajima Harima Jukogyo KK), Jan. 25, 1985.

* cited by examiner

*Primary Examiner*—M. Alexandra Elve
*Assistant Examiner*—I. H. Lin
(74) *Attorney, Agent, or Firm*—Friedrich Kueffner

(57) ABSTRACT

The invention relates to a method for controlling the temperature of a melt (10), preferably of a steel melt, in a distributing vessel (11), whereby the temperature of the melt is measured, the measured result is compared with a predetermined temperature range in the form of specified values, and as much heat is supplied or withdrawn from the melt such that the temperature remains inside said range. In order to control the melt temperature, a fireproof shaped part (20) which is closed on both sides and which is provided for accommodating a liquid cooled induction coil (1) is immersed in the melt (10). The transmission of heat is carried out by means of thermal conduction out of the wall of the shaped part (20) which is coupled to the induced electromagnetic field and/or by means of a direct coupling to the liquid melt (10). The shaped part (20) accommodates the induction coil (1) in an interhangeable manner while leaving cooling channels (9) open and is positioned from the outside by a manipulator (16) which can be lifted, lowered and tuned.

5 Claims, 5 Drawing Sheets

METHOD AND DEVICE FOR CONTROLLING AND/OR MAINTAINING THE TEMPERATURE OF A MELT, PREFERABLY OF A STEEL MELT DURING CONTINUOUS CASTING

This Application is a 371 of PCT/EP00/00058, filed Jan. 7, 2000.

BACKGROUND OF THE INVENTION

1. Field of the Invention

The invention relates to a method for controlling and/or maintaining the temperature of a melt, preferably a steel melt, wherein the temperature of the melt is measured in a vessel, the measured result is compared with a preset temperature range in the form of SPECIFIED values, and so much heat is supplied to the melt by electrical induction by means of an induction coil or removed from the melt by means of a cooling device that the temperature is within the SPECIFIED range. The invention also concerns a device for performing the method.

2. Description of the Related Art

During continuous casting, in particular of steel, a temperature of the melt as uniform as possible, respectively, maintaining a narrow temperature window is desirable in the distribution vessel, in the following also referred to as tundish, for quality and operational reasons. As a result of temperature losses of the melt within the ladle, during transfer from the ladle into the distributor and in the distributor itself, the casting duration is temporally limited.

By mounting a device for temperature control of the melt within the distribution vessel, different melt temperatures within the ladle can be compensated within the distributor and the possible casting duration can be extended. The advantages of such device furthermore reside in a greater flexibility when casting disturbances occur and, primarily, in the more uniform temperature level within the tundish. Quality advantages of the continuous casting product are expected from these measures. Also, casting closer to the liquids is possible.

Known devices for controlling the temperature in the distributor are, for example, plasma heating devices which are conventionally positioned above the distributor. The principle of plasma heating resides in that in a chamber, following vertically the filling level within the tundish, an electric arc is transmitted by electrodes onto a free metal surface. The arc is stabilized by argon; therefore the term plasma. In the area of the chamber a hot spot results and the steel must be guided past it, either across dams or banks or additional flushing devices, for example, porous bottom flushing devices that are permeable for gas.

A disadvantage of this method variant is the required free surface area of the melt within the chamber so that physical and chemical ad interactions between the chamber atmosphere and the melt are to be expected. As a result of the very high temperatures within the electric arc, steam and dust development will occur within the chamber.

Moreover, inductive tundish heating devices are known in which a differentiation is made between the so-called crucible inductors and gutter or channel inductors which are usually connected by being fixedly flanged with the construction components of the distributor. In this connection, the gutter inductors, relative to the crucible inductors, are comparatively complex in regard to manufacture and maintenance.

U.S. Pat. No. 5,084,089 describes induction coils arranged stationarily externally in a depressed area of a distributor and a cooling device immersed into the melt within the distributor for controlling the melt temperature.

Advantages of inductive heating result because of the lack of contact with the melt as well as the force generation within the melt stemming from the induced electromagnetic alternating field which causes a stirring movement of the melt and thus a faster heat distribution within the distribution vessel. Disadvantages of the above listed inductive tundish heating devices result from the fixed attachment to the tundish, which has a negative effect with regard to flexibility. Also, the required service and maintenance expenditures are significant.

The patent application DE 197 52 548 A1, not yet published at the time of filing of this application, concerns a method for controlling and maintaining the temperature, in particular of a steel melt, within narrow temperature limits over the casting duration of continuous casting wherein lowering of the temperature is compensated by heating. This method is improved in that the temperature of the melt is measured at the outlet of the distribution vessel, the measured result is compared with the preset lower temperature limit, and the melt, when reaching or falling below the limit, is heated until the temperature [makes possible an] advantageous temperature control of a metal melt in a distribution vessel.

For solving this object, it is suggested with the invention that in a method of the kind mentioned in the preamble of claim 1 for controlling the melt temperature an induction coil received in a refractory shaped part closed off at the bottom is immersed into the melt. The heating output of the device, in the following also referred to as a heating rod, is controlled by the current intensity of the current flowing through the induction coil. The induction coil is cooled from the interior and/or exterior by a cooling fluid, preferably air.

In this connection, the method suggests that heat is transmitted to the melt by thermal conduction via the wall of the shaped part which, in turn, is coupled to the induced electromagnetic alternating field.

As an alternative, heat can be supplied to the melt by means of coupling of the electromagnetic alternating field. Also, it is possible to remove heat from the melt by means of thermal conduction through the wall of the shaped part.

The invention comprises moreover a device for performing the method according to the invention, wherein the shaped part is provided with a refractory tube, that is closed at the bottom and can be inductively coupled and that receives the induction coil in an

SUMMARY OF THE INVENTION

Based on the aforementioned prior art, it is an object of the invention to provide a method of the aforementioned kind as well as a device suitable for performing the method which, while avoiding the disadvantages and difficulties present in the prior art, provide a technically uncomplicated, flexible and thus economically advantageous temperature control of a metal melt in a distribution vessel.

BRIEF DESCRIPTION OF THE DRAWINGS

Further details and features of the invention result from the following explanation of an embodiment illustrated schematically in the drawing.

DESCRIPTION OF PREFERRED EMBODIMENTS

Figure 1:
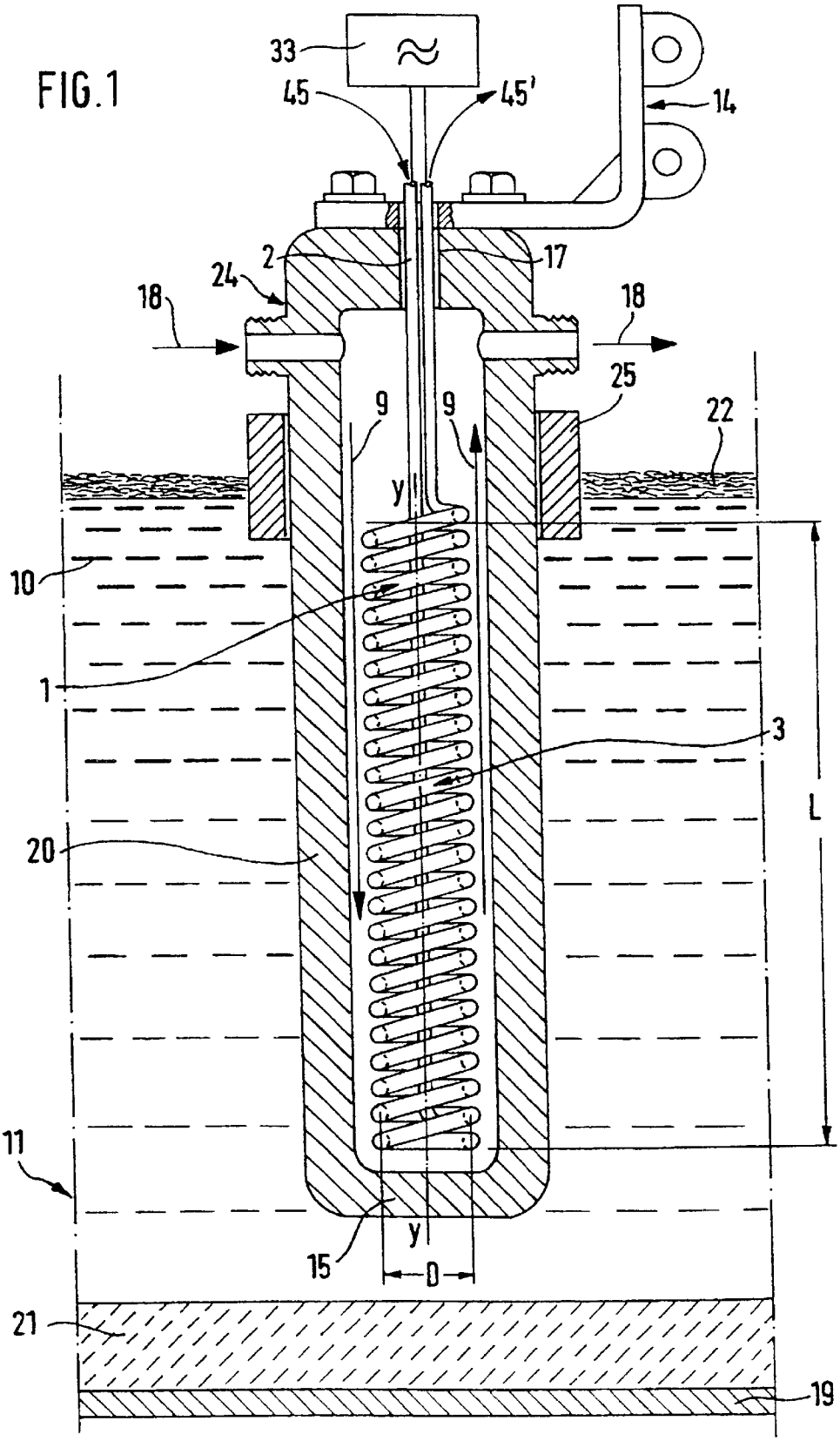
FIG. 1 a heating rod according to the invention in longitudinal section.

The heating rod 20 illustrated in FIG. 1 for performing the method according to the invention comprises an induction coil of a conductor 2, through which current flows and which is cooled inwardly with a fluid 45, 45', the coil comprising a number of windings 3 arranged along a vertical axis y-y with a relatively small winding diameter D in comparison to the coil length L and being positioned in a refractory shaped part 24. The shaped part 24 comprises a closed bottom 15 and receives like a sleeve 24 the induction coil 1 in an exchangeable way, with a tubular hollow space being formed and vertical cooling channels 9 being left open. At the upper end outlets 17 for passing through the conductor 2, which is cooled from the interior, as well as connectors 18 for supplying and removing additional cooling fluid and securing elements 14 for connecting linkage arms 23 of a manipulator 16 are provided.

The sleeve or wall 24 of the heating rod 20 is comprised of refractory material (compare, for example, EP 0 526 718 B1) which can be coupled to the electromagnetic alternating field of the induction coils 1. The heat transfer is carried out by thermal conduction from the wall 20 into the melt 10. Moreover, the melt 10, by changing the induced alternating field, can be supplied with heat by direct coupling. As a result of particular properties of the sleeve material 24 it can be inductively heated without a foreign heating device and without the presence of surrounding coupling material.

FIG. 1 shows furthermore a detail of a distributor 11 with liquid steel melt 10 contained therein and a slag layer 22 floating on top. The material of the sleeve 24 is substantially inert relative to the steel melt 10, but is reinforced with an additional slag protection sleeve 25 against mechanical and chemical wear in the area of the slag layer 22. The bottom of the distributor 11 is formed by a steel cover 19 with a refractory lining 21. The controlled supply of alternating current of the induction coil 1 is identified symbolically with 33.

In the additional FIGS. 2*a*, 2*b* to 5*a*, 5*b* same elements are identified with same reference numerals, respectively.

Figure 2A:
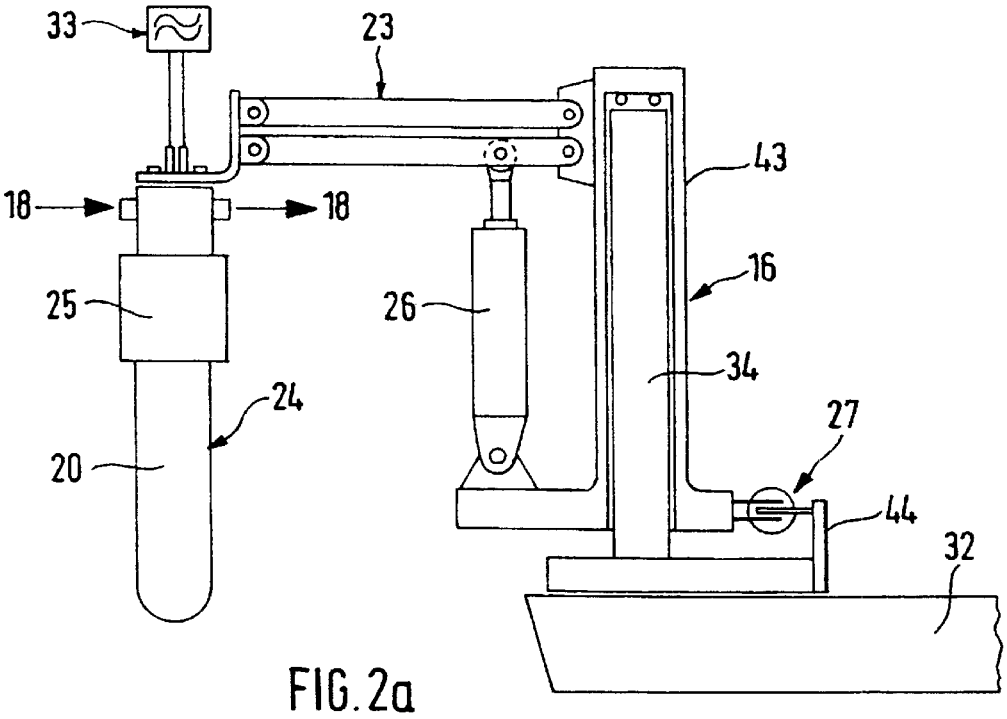
FIG. 2*a* the heating rod in a side view in cooperation with a manipulator.

FIG. 2*a* shows the heating rod 20 with slag protection sleeve 25 and media connectors 18 and 33 in connection with a manipulator 16.

The manipulator 16 comprises a guide column 34 on a steel frame 32 with a rotatable and liftable sleeve 43 and is connected in an articulated way by the linkage arms 23 with the heating rod 20. The manipulator 16 has, on the one hand, a lifting and lowering device 26 in the form of a hydraulic element and, on the other hand, a hydraulically operated devise 27 for pivoting the linkage arms 23.

Figure 2B:
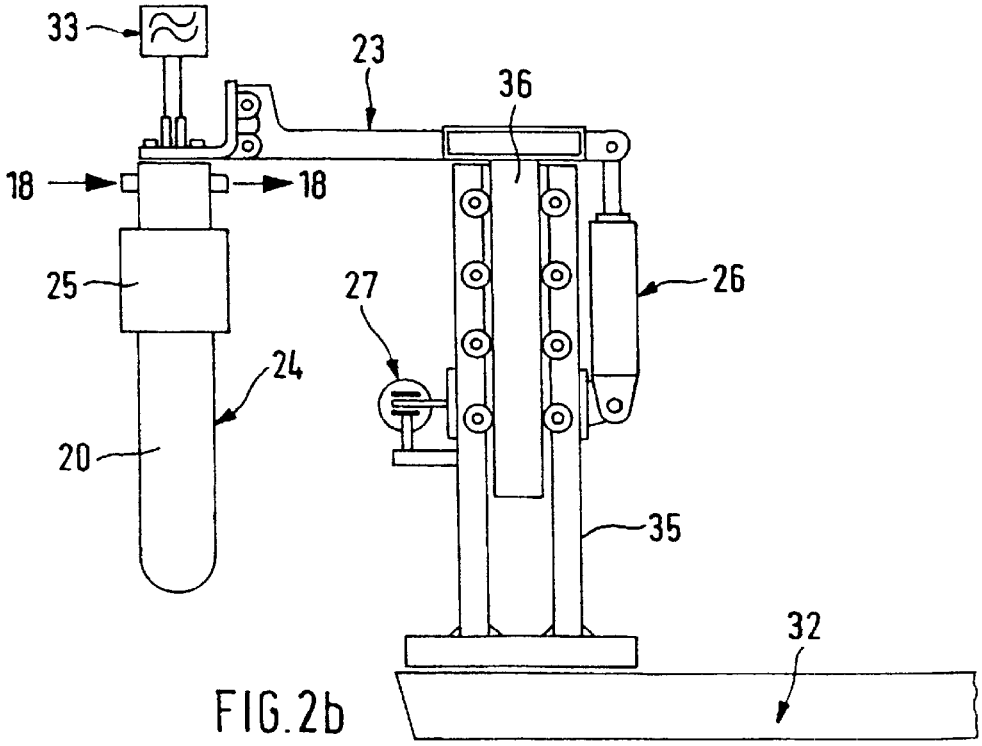
FIG. 2*b* the heating rod in a side view with a different manipulator.

An alternative device according to FIG. 2*b* has a stationary guide 35 on a steel frame 32 which receives a support element 36 which is movable between guide rolls in the vertical direction and is also swivelable. The numerals 26 and 27 identify the required lifting and lowering as well as swiveling devices.

Figure 3A:
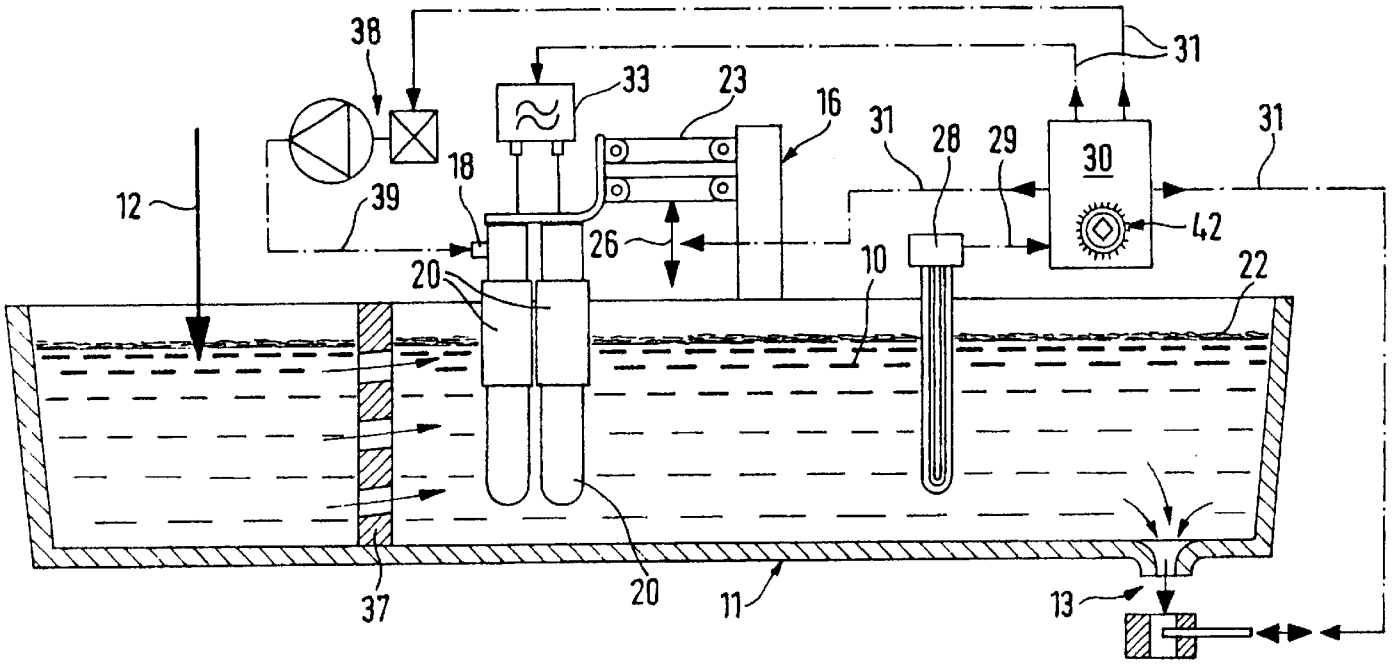
FIG. 3*a* a section in a side view of the distributor with the heating rods immersed in the melt as well as a temperature sensors in cooperation with a device for controlling the temperature of the melt.
Figure 3B:
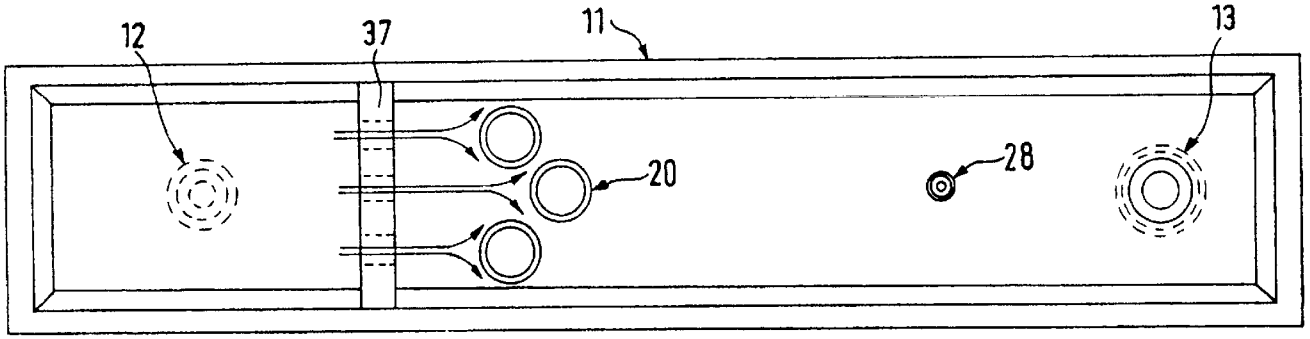
FIG. 3*b* a distributor according to FIG. 3*a* in a plan view.

The heating rod 20 or heating rod groups according to FIGS. 3 to 5 immersed into the melt 10 have correlated therewith a temperature sensor 28, respectively, and can be connected with a signal line 29 to a computer unit 30 which adjusts or controls via control lines 31 the movements of the manipulator 16 and the current intensity 33 for controlling the electromagnetic alternating field according to the measured temperature values of the melt 10. This is indicated schematically in the corresponding control schematic in FIG. 3*a*. The computer unit 30 compares the measured values with the preset specified values and controls the heating output of the heating rods 20 when corresponding deviations occur. Moreover, by means of the computer unit 30 and the control lines 31, the cooling fluid supply for the inner cooling of the current conductor and the fluid cooling of the heating rods 20 via the cooling fluid supply line 39 and the cooling fluid connector 18 can be monitored and controlled so that heat can be removed from the heating rods 20 and the melt 10 when overheating occurs.

FIG. 3*a* shows furthermore an elongate configuration of the distributor 11 with inlet 12 for liquid steel and a controllable outlet 13. Between inlet 12 and outlet 13 at least one temperature Esensor 28 is arranged and connected via a signal line 29 with the computing unit. For a preferred flow control of the metal melt, a partition 37 with openings allowing flow therethrough is arranged in the distributor or tundish 11 so that a better flow distribution about the heating rods 20 for a more uniform heat removal or heat supply is achieved, according to the plan view of FIG. 3*b*.

Figure 4A:
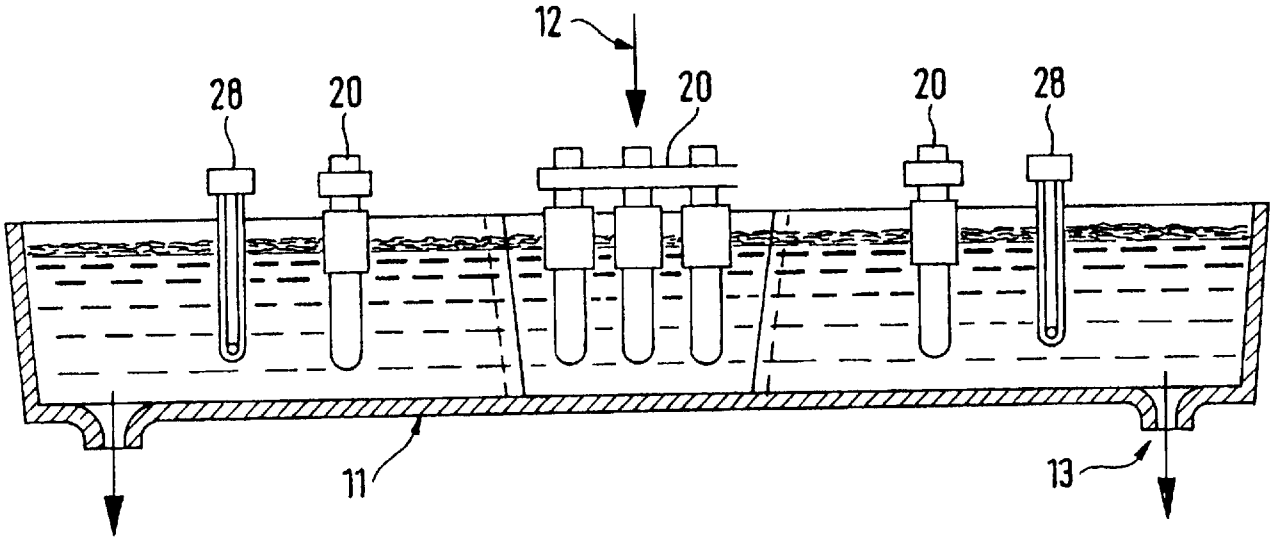
FIG. 4*a* a section in side view of a differently configured distributor.
Figure 4B:
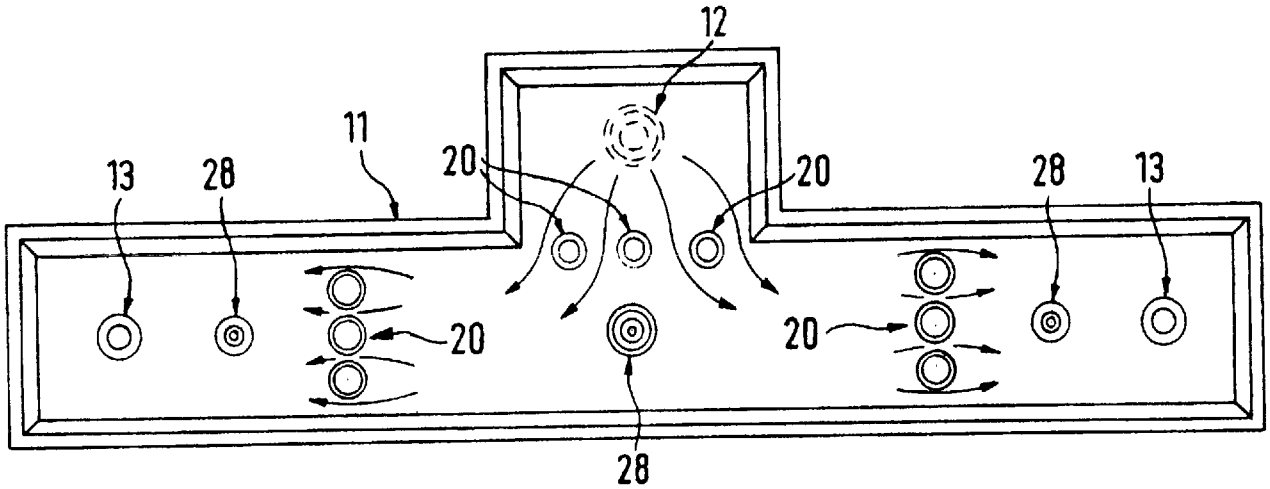
FIG. 4*b* an arrangement according to FIG. 4*a* in a plan view.

In FIGS. 4*a* and 4*b* another configuration of the distributor 11 with central supply 12 for the melt and two laterally arranged controlled outlets 13 is illustrated. The multi-arrangement of individual controllable heating rods 20 or heating rod groups and the correlated temperature sensors 28 provides an even more exact monitoring of the melt temperature in the distributor 11.

Figure 5A:
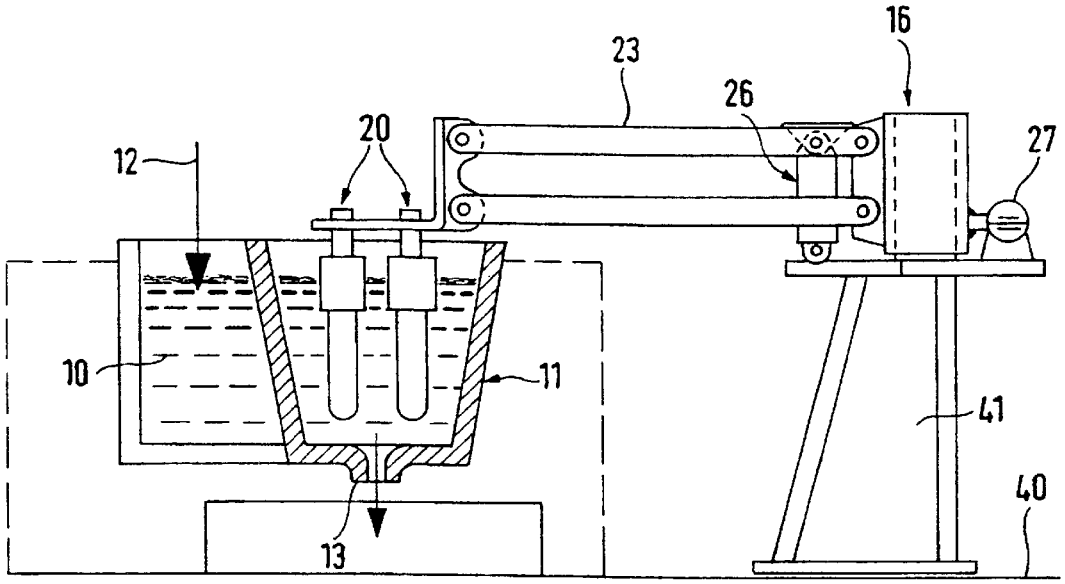
FIG. 5*a* an arrangement shown in section along V—V of FIG. 5*b* of an alternative distributor shape with immersed heating rods guided by means of a frame installed on the casting platform.
Figure 5B:
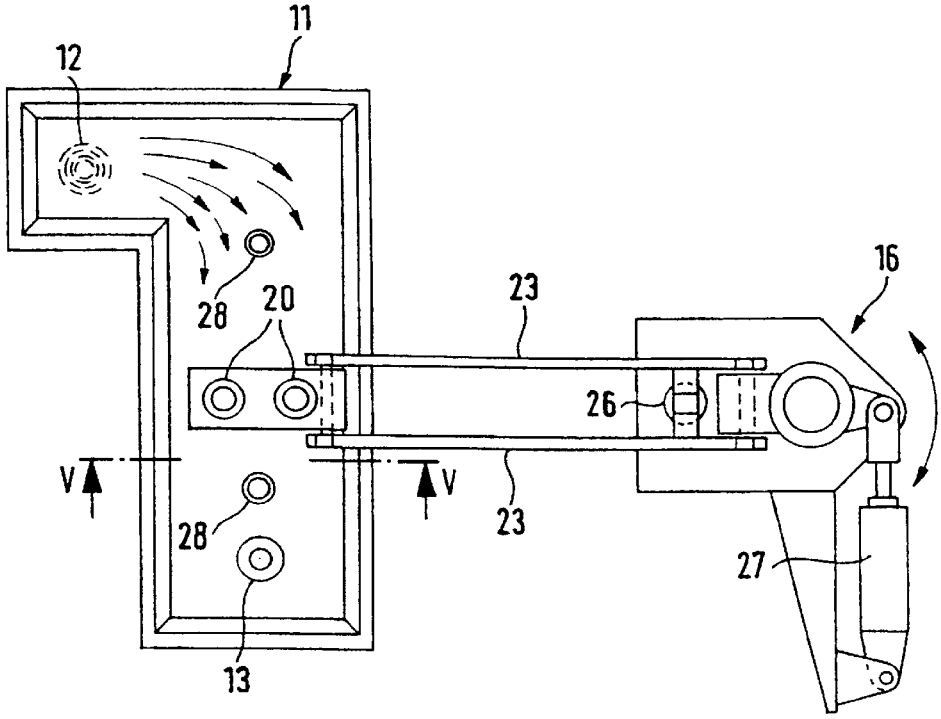
FIG. 5*b* an arrangement according to FIG. 5*a* in a plan view.

In FIGS. 5*a* and 5*b* a configuration of the distributor 11 in an L-shape is illustrated. Between the inlets 12 and the outlets 13, an arrangement of two heating rods 20 is provided between two temperature sensors 28, respectively. They are connected by pivotably articulated linkage arms 23 with the manipulator 16 and are thus arranged to be movable in the vertical as well as horizontal direction in a liftable and rotatable manner. The manipulator 16 is fixedly connected by a frame 41 with the casting stage 40 of the continuous casting device. The arrangement shows also, similar to FIGS. 2*a* and 2*b*, lifting 26 and swiveling devices 27 for positioning the heating rods 20 within the melt 10 in the distributor 11.

A method according to the invention and the device configured for performing it according to FIGS. 1 through 5 can be adapted optimally to the constructive conditions of corresponding distributor shapes and other casting stage components. In this way, a simple retrofitting of already existing facilities with the device is possible.

What is claimed is:

1. A method for controlling and maintaining a temperature of a metal melt (10), the method comprising the steps of:

measuring a melt temperature of a metal melt (10) contained in a vessel;

comparing the melt temperature with a preset temperature range in the form of specified values;

immersing a heating rod (20) into the metal melt (10), wherein the heating rod (20) comprises a refractory tubular shaped part (24) with a closed bottom and comprises an induction coil (1) arranged inside the refractory tubular shaped(24), the refractory shaped part (24) configured to be coupled to and heated by an electromagnetic alternating field of the induction coil (1);

regulating the melt temperature by supplying heat or removing heat from the metal melt (10) such that the temperature of the metal melt (10) lies within the preset temperature range, wherein heat is transferred by heat conduction from a wall of the refractory tubular shaped part (24) into the metal melt (10), and wherein a material of the refractory shaped part has properties allowing inductive-heating of the refractory tubular shaped part without foreign heat and without a coupling material surrounding the refractory tubular shaped part (24) for coupling with the electromagnetic alternating field being present.

2. The method according to claim 1, further comprising the step of reinforcing the material of the refractory tubular sleeve (24), which material is substantially inert relative to the metal melt, in an area of a slag layer of the metal melt (10) by providing a slag protection sleeve (25).

3. The method according to claim 1, wherein the induction coil (1) comprises an electric-current conducting conductor (2) having an interior configured to be cooled by a fluid (45, 45') and formed to a coil comprising several windings about a vertical axis, wherein the windings have a diameter significantly smaller than a length of the coil.

4. The method according to claim 1, wherein the refractory tubular shaped part (24) has a tubular hollow interior and forms a sleeve, wherein the induction coil (1) is exchangeably arranged in the hollow interior of the sleeve and vertical cooling channels (9) are provided between the induction coil and the inner walls of the sleeve.

5. A device for controlling and maintaining a temperature of a metal melt (10), by measuring a melt temperature of a metal melt (10) contained in a vessel; comparing the melt temperature with a preset temperature range in the form of specified values; the device comprising:

a heating rod (20) configured to be immersed into the metal melt, wherein the heating rod (20) comprises a refractory tubular shaped part (24) with a closed bottom and further comprises an induction coil (1) arranged inside the refractory tubular shaped part (24);

wherein the refractory shaped part (24) is configured to be inductively coupled to and heated by an electromagnetic alternating field of the induction coil (1); and wherein a material of the refractory shaped part (24) has properties allowing inductive heating of the refractory tubular shaped part (24) without foreign heat and without a coupling material surrounding the refractory tubular shaped part (24) for coupling with the electromagnetic alternating field being present.

* * * * *